US005542903A

United States Patent [19]

Nishida et al.

[11] Patent Number: 5,542,903

[45] Date of Patent: Aug. 6, 1996

[54] CENTRIFUGAL LIQUID SEPARATING MACHINE USING DECELERATION VANES

[75] Inventors: Katsunori Nishida; Keiichiro Miyano, both of Tokyo; Masaki Iwase, Chiba-ken; Eiji Ichinose, Kanagawa-ken, all of Japan

[73] Assignee: Tsukishima Kikai Co., Ltd., Tokyo, Japan

[21] Appl. No.: 168,353

[22] Filed: Dec. 17, 1993

[30] Foreign Application Priority Data

Dec. 18, 1992 [JP] Japan ..... 4-338467
Dec. 14, 1993 [JP] Japan ..... 5-313721

[51] Int. Cl.[6] ..... B04B 1/20; B04B 11/02

[52] U.S. Cl. ..... 494/53; 494/56

[58] Field of Search ..... 494/52–56, 85; 210/380.1, 380.3

[56] References Cited

U.S. PATENT DOCUMENTS

| | | | |
|---|---|---|---|
| 2,435,623 | 2/1948 | Forsberg | 494/53 X |
| 2,743,865 | 5/1956 | Graae | 494/53 |
| 3,279,687 | 10/1966 | Amero | 494/53 X |
| 4,566,873 | 1/1986 | Toda | 494/53 |
| 4,790,806 | 12/1988 | High | 494/53 X |

FOREIGN PATENT DOCUMENTS

| | | | |
|---|---|---|---|
| 647761 | 5/1964 | Belgium | 494/53 |
| 159422A1 | 10/1985 | European Pat. Off. . | |
| 237067A3 | 9/1987 | European Pat. Off. . | |
| 3317047A1 | 1/1984 | Germany . | |
| 3501341A1 | 7/1986 | Germany . | |
| 3822983 | 1/1990 | Germany | 494/53 |
| 62-45363 | 2/1987 | Japan . | |
| 62-136237 | 8/1987 | Japan . | |
| 63-31261 | 6/1988 | Japan . | |
| 2-86652 | 7/1990 | Japan . | |
| 2-86653 | 7/1990 | Japan . | |
| 2088255 | 6/1982 | United Kingdom . | |

*Primary Examiner*—Charles E. Cooley
*Attorney, Agent, or Firm*—Lowe, Price, LeBlanc & Becker

[57] ABSTRACT

Discharge passages for concentrated and separated liquids are separately formed in shafts of a rotary bowl 1 and a screw conveyor 2. In an inlet passage of the radial discharge passage leading from the inside of the rotary bowl 1 to the discharge passage in the shaft, an annular space is divided into sectors by a plurality of deceleration vanes 23, 24 which are mounted on the screw conveyor 2 and extend in a radial direction from the axis of the machine.

13 Claims, 14 Drawing Sheets

CENTRIFUGAL LIQUID SEPARATING MACHINE USING DECELERATION VANES

BACKGROUND OF THE INVENTION a. Field of the Invention

The present invention relates to a centrifugal concentrating machine and in particular to a screw decanter type centrifugal concentrating machine.

b. Description of Prior Art

Such decanter type centrifugal concentrating machine has a screw conveyor which is coaxially disposed within a rotary bowl which is rotated at a high speed. The rotary bowl and the screw conveyor are rotated in the same direction at different speeds. Liquid to be treated which is charged into the rotary bowl is sedimented on the inner wall of the rotary bowl by a centrifugal force and is separated into clarified liquid and concentrated liquid. The concentrated liquid is scraped toward one side of the machine by the screw conveyor and is discharged via a concentrated liquid discharge port while the clarified or separated liquid is discharged outside via a separated water discharge ports at the opposite side of the machine.

Various mechanisms for discharging the concentrated liquid and the separated liquid (both referred to as liquid to be discharged) have heretofore been developed. One of them is disclosed in, for example, Japanese Examined Patent Publication No. Sho 63-31261.

In the prior art, it is necessary to provide the liquid to be discharged with a high circumferential speed since the liquid to be discharged should be discharged via a discharge port formed on the outer periphery of the rotary bowl. The disclosed invention aims at eliminating the necessity to rotate the rotary bowl and the screw conveyer at a high speed in the prior art. At this end, a plurality of skimmer tubes are secured to the end face of the hub of a screw conveyer. The skimmer tubes extend in a radial direction so that their open ends are close to the inner wall of the rotary bowl to lead the concentrated liquid which has been scraped by the screw blades toward the side of the hollow supporting shaft of the rotary bowl through the skimmer tubes.

A plurality of radial guide passages which are formed on the hub of the screw conveyer, open on the outer surface of the hub to communicate with the hollow supporting shaft of the screw conveyer. The separated liquid is discharged outside via the hollow supporting shaft. The concentrated liquid is discharged outside through a space between the supporting shafts of the screw conveyer and the rotary bowl. A port of the discharge passage in the supporting shaft of the screw conveyer is provided with a flow rate adjusting means for adjusting the flow rate of the discharged separated liquid.

Other apparatus for discharging concentrated liquid and the like from an axial portion in order to reduce consumed power are disclosed in Japanese Unexamined Patent Publication No. Tokkai-Sho 62-45363, Japanese Unexamined Utility Model Publication Nos. Jikkai-Sho 62-136237, Jikkai-Hei 2-86652 and 2-86653.

Although the apparatus which is disclosed in Japanese Examined Patent Publication No. Sho 63-31261 in which the liquid to be discharged is discharged via a supporting shaft has an advantage in that the consumed power is less, wear of the inner wall surface of skimmer tubes through which concentrated liquid containing much fine solid content flows is remarkable and clogging is liable to occur since the skimmer tubes and guide passages which extend in a radial direction have a constant cross section in a radial direction and are narrow. Since the inlet ports of the skimmer tubes are narrow, dead spaces are liable to be formed. The concentration of the discharged concentrated liquid changes with the lapse of time.

Reduction in the diameters of the skimmer tubes to provide a compact machine will worsen the above mentioned problem. Accordingly, small size centrifugal machines can not be provided.

SUMMARY OF THE INVENTION

It is, therefore, a main object of the present invention to provide a centrifugal concentrating machine which is capable of smoothly discharging the concentrated and separated liquids and of reducing the consumed power necessary for the operation.

It is another object of the present invention to provide a centrifugal concentrating machine in which the balance between the flow rates of the discharged concentrated and separated liquids can be readily adjusted.

In a first aspect of the present invention, there is provided a centrifugal concentrating machine for separating liquid fed to a space between said rotary bowl and a screw conveyor into concentrated liquid and separated liquid by a centrifugal force and for discharging them outside via independent discharge passages, having a screw conveyor which is coaxially disposed within the rotary bowl, the rotary bowl and the screw conveyor being rotated in the same direction at different high speeds, characterized in that both supporting shafts of said screw conveyor are hollow, a horizontal discharge passage for the concentrated liquid being formed in the one of the supporting shafts, a horizontal discharge passage for the concentrated liquid being formed in the other of the supporting shafts, these horizontal passages being in communicated with said space via radially extending discharge passages to form respective discharge passages for the concentrated and separated liquids; and in that an annular space Constituting at least an inlet passage through which the liquid flows toward the axis in at least one of said radial discharge passages is divided into sectors by a plurality of deceleration vanes which are arranged in a radial direction and are secured to the screw conveyor or the rotary bowl so that the mutual spacings between the adjacent sectors become wider in an outer radial direction.

In a second aspect of the preset invention, there is provided a centrifugal concentrating machine for separating liquid fed to a space between said rotary bowl and a screw conveyor into concentrated liquid and separated liquid by a centrifugal force and for discharging them outside via independent discharge passages, having a screw conveyor which is coaxially disposed within the rotary bowl, the rotary bowl and the screw conveyor being rotated in the same direction at different high speeds, characterized in that one of the supporting shafts of said screw conveyor is hollow, a discharge tube being coaxially disposed in the one of the supporting shafts, a horizontal discharge passage for the concentrated liquid being formed in one of the inside of said discharge tube and a spacing between the discharge tube and said supporting shaft, a horizontal discharge passage for the separated liquid being formed in the other spacing, each of these horizontal discharge passage being in communication with said space via a radial discharge passage extending in a radial direction to form the discharge passages for the concentrated and separated liquids, and in that an annular space constituting at least an inlet passage through which a liquid flows toward the axis in at least one of said radial discharge passages is divided into sectors by a plurality of deceleration vanes which are arranged in a radial direction and are secured to the screw conveyor or the rotary bowl so that the mutual spacings between the adjacent sectors become wider in an outer radial direction.

The deceleration vanes can be mounted on the screw conveyor in a suitable manner.

In a third aspect of the present invention, there is provided a centrifugal concentrating machine for separating liquid fed to a space between said rotary bowl and a screw conveyor into concentrated liquid and separated liquid by a centrifugal force and for discharging them outside via independent discharge passages, having a screw conveyor which is coaxially disposed within the rotary bowl, the rotary bowl and the screw conveyor being rotated in the same direction at different high speeds, characterized in that one of the supporting shafts in said rotary bowl is hollow, the other supporting shaft in said screw conveyor being hollow, a horizontal discharge passage for the concentrated liquid being formed either one of the inside of the one supporting shaft of said screw conveyor or space between the one supporting shaft or the other supporting shaft of the screw conveyor and said one supporting shaft of said rotary bowl, these horizontal passages being in communicated with said space via radially extending discharge passages to form respective discharge passages for the concentrated and separated liquids; and in that an annular space constituting at least an inlet passage through which liquid flow toward the axis in at least one of said radial discharge passages is divided into sectors by a plurality of deceleration vanes which are arranged in a radial direction and are secured to the screw conveyor or the rotary bowl so that the mutual spacings between the adjacent sectors become wider in an outer radial direction.

In each embodiment, the screw conveyor may be formed at the end of the hub thereof on the discharge side of the concentrated liquid with a dip weir portion which projects from the outer surface of the hub toward the inner wall of the rotary bowl.

The deceleration vanes may be mounted on the screw conveyor in a suitable manner.

The deceleration vanes may be arranged so that they are in the form of blades of a spiral pump in section.

In accordance with the present invention, an annular space in the inlet passage of the radial discharge passage in which the concentrated and/or separated liquid flows toward at least the axis is divided into sectors by a plurality of the deceleration vanes which are disposed in a radial direction and are secured to the screw conveyor or the rotary bowl.

As a result, the liquid to be discharged between the adjacent deceleration vanes is divided by the adjacent deceleration vanes. Accordingly, it has a circumferential speed which is proportional to the radius r from the central axis of the centrifugal concentrating machine due to the rotation of the screw conveyor. As a result, the radius r of the liquid to be discharged decreases as it approaches to the central axis. The circumuferential speed of the liquid gradually decreases. The liquid is passed through the horizontal discharge passage and is discharged outside at a decreased kinetic energy ($V=mV^2/2$). Therefore, the driving power for rotating the machine can be reduced by an amount equivalent to the decrease in the kinetic energy.

Wear of the inner walls of the skimmer tubes and/or clogging of the tubes occurs in the prior art as mentioned above in case where skimmer tubes having a constant cross section and a small inner diameter are used. In contrast to this, since the liquid is discharged via sectors or fan-shaped passages which are diverged along the outer radial direction, no clogging occurs in the entrance zone having a large sectional area. Although the sectional area of the passage decreases as it approaches toward the central axis, the kinetic energy of the liquid decreases. Accordingly, no or few wear of the deceleration vanes occurs.

On the other hand, if no deceleration vanes are provided, the concentrated liquid exhibits free eddy currents in the vicinity of the inner wall of the rotary bowl. The liquid does not have a circumferential speed which is proportional to the radius from the central axis of the centrifugal concentrating machine while it has a circumferential speed which is not less than the circumferential speed of the liquid near the inner wall of the rotary bowl. This resists against the liquid flowing toward the central axis so that the flow rate of the discharged liquid is remarkably lowered. The rotational driving power can not be reduced by decreasing the kinetic energy of the liquid.

The balance between the amounts of the discharged concentrated and separated liquids can be adjusted by changing the number, height and width of the deceleration vanes. Control of the concentration of the concentrated liquid can be easily accomplished.

Although pressure losses of the liquid when the liquid flows through the skimmer tubes are large in the prior art using the skimmer tubes, the pressure losses are greatly less in the present invention since the liquid flows through sector-shaped wide passages. Accordingly, only a low power to operate the pump for feeding the liquid to be treated is required.

DESCRIPTION OF THE PREFERRED EMBODIMENTS

Now, the present invention will be described in detail by way of embodiments with reference to the drawings.

Figure 1:
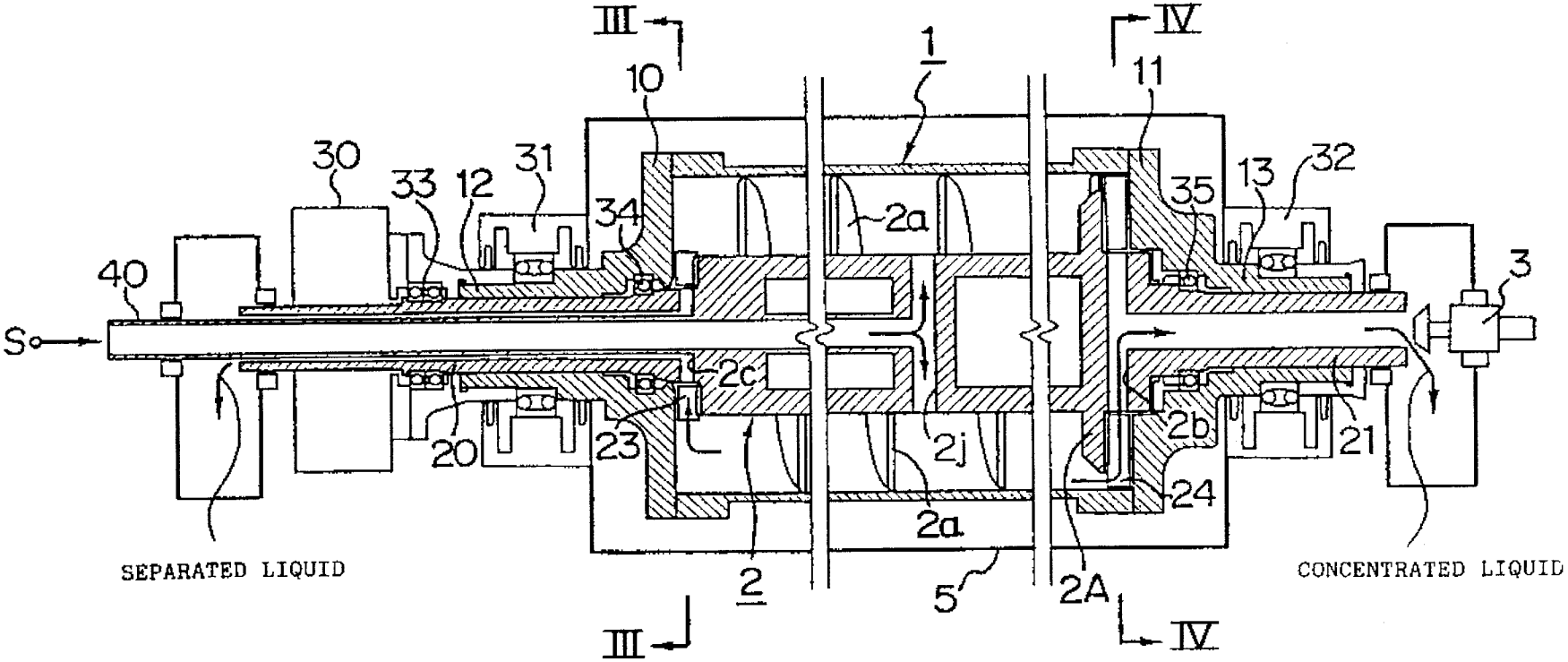
FIG. 1 is a longitudinal sectional view showing a first embodiment of a centrifugal concentrating machine of the present invention.

A decanter type centrifugal concentrating machine includes hollow supporting shafts 12 and 13 extending from opposite side walls 10 and 11 of a rotary bowl 1, respectively as shown in FIG. 1. The hollow shafts 12 and 13 are formed integrally with each other. These shafts 11 and 12 are rotatably journalled by bearings 31 and 32, respectively and are driven to rotate at a high speed by a reduction gear in a gear box 30.

A screw conveyor 2 is coaxially disposed within the rotary bowl 1. The screw conveyor 2 has a spiral screw blade 2*a* which is spirally secured to the periphery of the hub thereof and is slightly separated from the inner peripheral surface of the rotary bowl 1. Hollow shafts 20 and 21 which are horizontally extended from the opposite end faces of the screw conveyor 2 are rotatably journalled by bearings 33, 34 and 35, respectively so that the screw conveyor 2 is rotated at a high speed. The rotary bowl 1 and the screw conveyor 2 are rotated in the same direction at different speeds.

A liquid to be treated is charged into the rotary bowl 1 via a feed tube 40 and a passage 2*j*. The feeding tube 40 is disposed within and is spaced from a hollow shaft 20 integral with the screw conveyor 2 so that an annular space is formed therebetween. The liquid is scattered toward the inner peripheral wall of the rotary bowl 1 by a centrifugal force from the screw conveyor 2. Sedimentation occurs by the action of the centrifugal force so that the liquid to be treated is separated into concentrated liquid and separated liquid. The concentrated liquid or concentrate is scraped out by the blade 2*a* of the screw conveyor 2 and is conveyed rightward and is then discharged outside via a horizontal discharge passage within the hollow shaft 21 after passing through a radial discharge passage 2*b* for the concentrated liquid. A valve device 3 having a valve which is moved by a piston toward and away from an open end of the horizontal discharge passage in the hollow shaft 21 is provided to adjust the amount of the concentrated liquid.

On the other hand, the separated liquid is passed through a separated water discharge horizontal passage 2*c* formed at an end opposite to the port 2*b* and is then discharged outside from an annular space between the feed tube 40 and the hollow shaft 20.

Inlet passages to the liquid discharge passages 2*c* and 2*b* for the separated and concentrated liquids are provided with deceleration vanes 23 and 24 of the present invention, respectively. The respective discharge portions will be described in detail.

Figure 2:
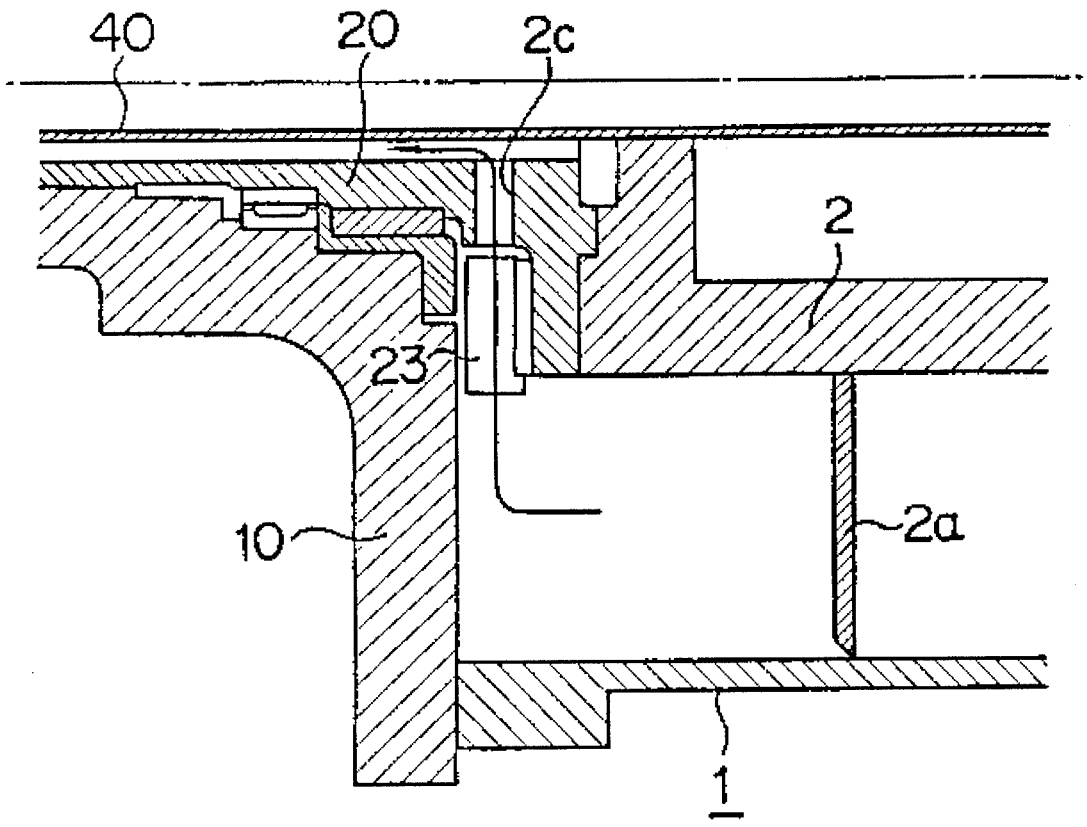
FIG. 2 is a enlarged view of separated liquid discharging portion.
Figure 3:
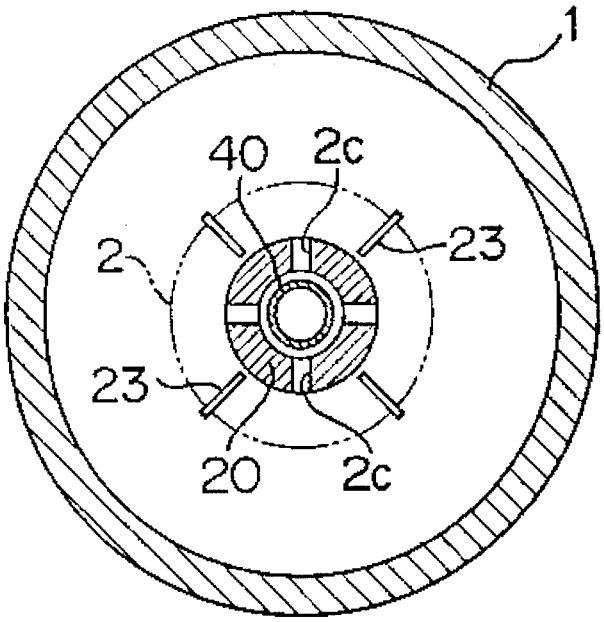
FIG. 3 is a sectional view taken along a line III—III in FIG. 1.

As shown in FIGS. 2 and 3, the separated liquid discharge portion is formed with radially extending separated liquid passages 2*c* which are formed through the end portion of the hub of the screw conveyor 2 to which the axially extending hollow shaft 20 is connected. An open free space which is not narrow unlike the above mentioned skimmer tube, but annular in shape for communicating the radial passage 2*c* with the space between the screw conveyor 2 and the bowl 1 is formed around the discharge passages 2*c*. The annular open free space is defined between the inner end face of the bowl 1 and the outer end face of the screw conveyor 2 and is divided into sectors by four radially extending deceleration vanes 23 formed on the outer end face of the screw conveyor 2. The outer radial ends of the deceleration vanes 23 slightly extend beyond the outer surface of the screw hub, but does not extend to the vicinity of the inner surface of the bowl 1 so that only clarified separated liquid is discharged. The separated liquid approaches to the axis of the machine as its circumferential speed is decreased with the deceleration vanes 23 and reaches to the horizontal discharge passage between the feed tube 40 and the hollow shaft 20 and is then discharged outside via this horizontal discharge passage.

Figure 4:
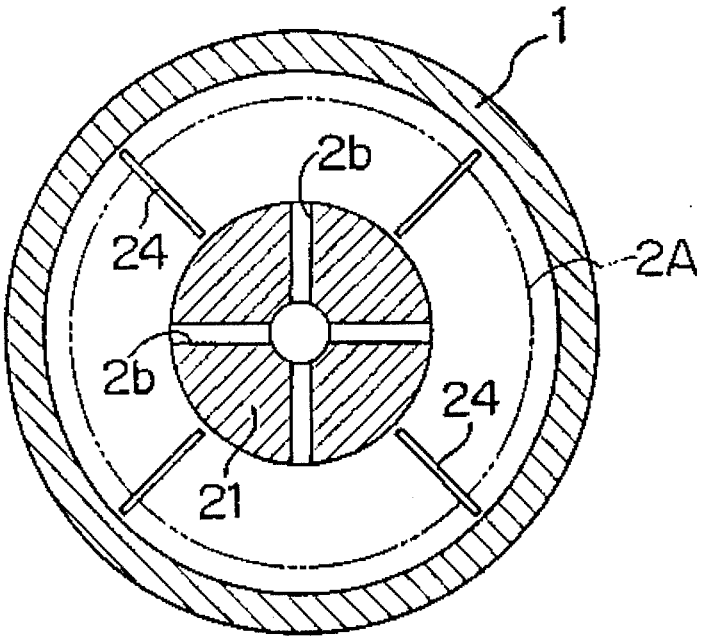
FIG. 4 is a sectional view taken along a line IV—IV in FIG. 1.

On the other hand, as shown in FIG. 4, the discharge portion for the concentrated liquid also includes an open space which are divided into sectors by four radially extending deceleration vanes 24 secured to a dip weir portion 2A of the other end face of the hub of the screw conveyor 2. The deceleration vanes 24 has an inner radial ends which are close to the outer periphery of the hollow shaft 21 and has outer radial ends which are so spaced from the inner peripheral wall of the rotary bowl at a distance of several millimeters so that the sedimented concentrated liquid is discharged over the dip weir 2A projecting toward the inner peripheral wall of the rotary bowl 1 from the end of the screw conveyor 2.

Although adjustment of the concentration of the concentrated liquid and the concentration of the solid content in the separated liquid and the amount of the discharged liquid and water can be accomplished by means of the throttle valve 3 provided at a port of the horizontal discharge passage for the concentrated liquid and by operating the rotary bowl 1 and the screw conveyor 2 at different speeds, it may be accomplished by changing the number of width and height the preliminarily preset deceleration vanes 24 depending upon the quality of the supplied liquid. In this case, a decrease in the number of the deceleration vanes 23, 24 decreases the reduction rate of the circumferential speed of the liquid flowing in an inner radial direction toward the central axis. The kinetic energy of the liquid functions as a resistive force to reduce the amount of the discharged liquid, making it possible to adjust the concentrations of the liquids.

Figure 5:
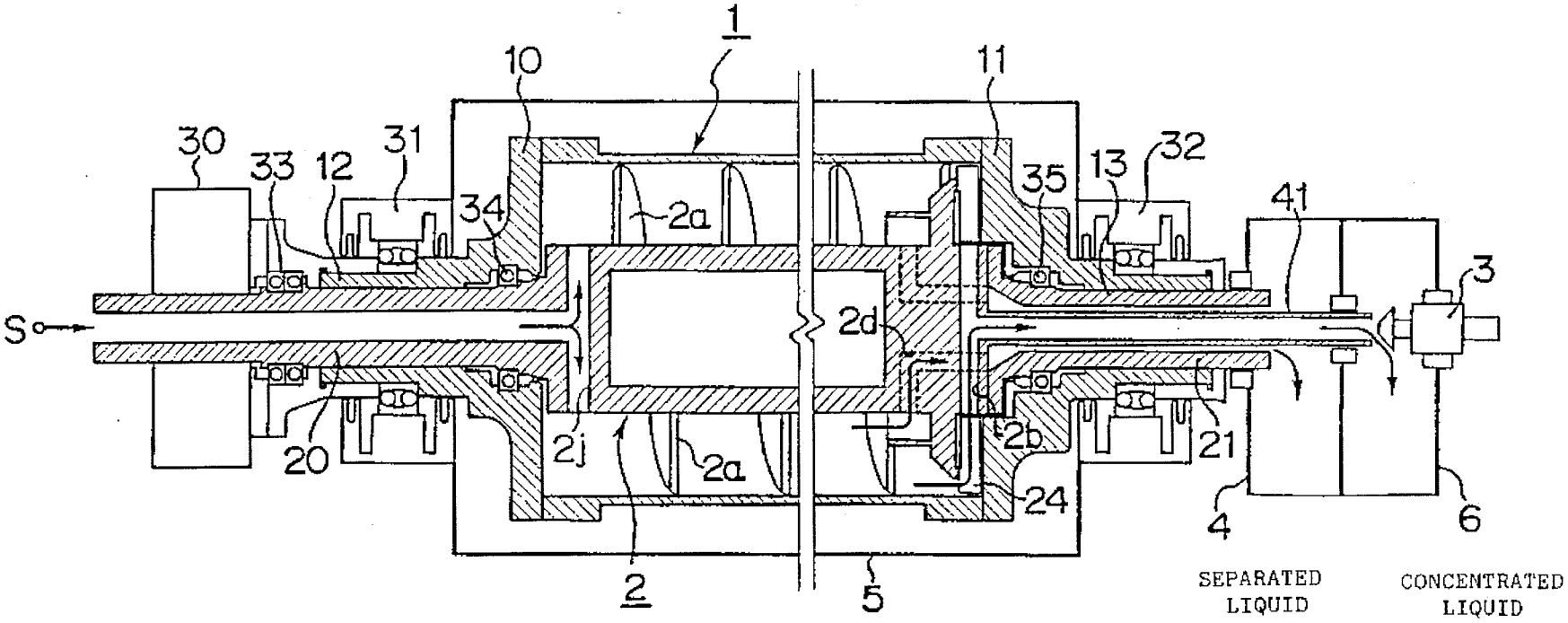
FIG. 5 is a longitudinal sectional view showing a second embodiment of a centrifugal concentrating machine of the present invention.

Referring now to FIG. 5, there is shown a second embodiment of the centrifugal concentrating machine in which discharge portions for the concentrated and separated liquids are formed on the same (right) side. The liquid to be treated S is charged into the rotary bowl 1 after passing through an inner passage of the hollow shaft 20 for the screw conveyor, which is on the side opposite to the discharge side.

While the liquid to be treated S is fed over the length which is longer than that of the first embodiment, it is clearly separated into concentrated and separated liquids. Similarly to the first embodiment, the concentrated liquid is passed through the deceleration vane 24 mounted area and is discharged outside via a concentrated liquid discharge tube 41 formed within the hollow shaft 21.

The separated liquid is discharged outside via an annular horizontal passage between the concentrated liquid discharge tube 41 and the screw conveyor hollow shaft 21 after passing through the separated liquid discharge L-shaped passage 2*d* formed within the hub of the screw conveyor 2.

Figure 6:
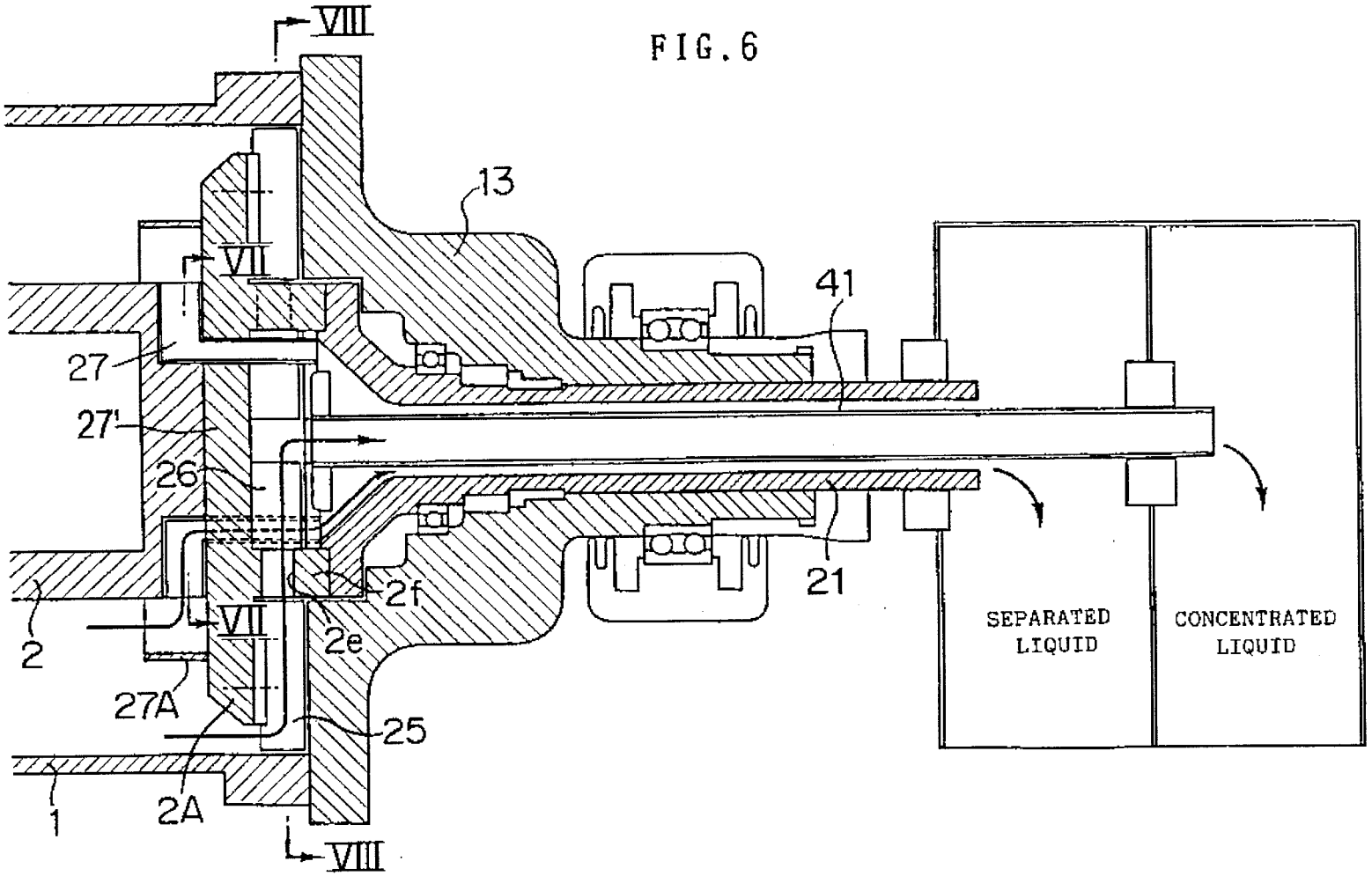
FIG. 6 is a longitudinal sectional view showing a third embodiment of a centrifugal concentrating machine of the present invention.
Figure 7:
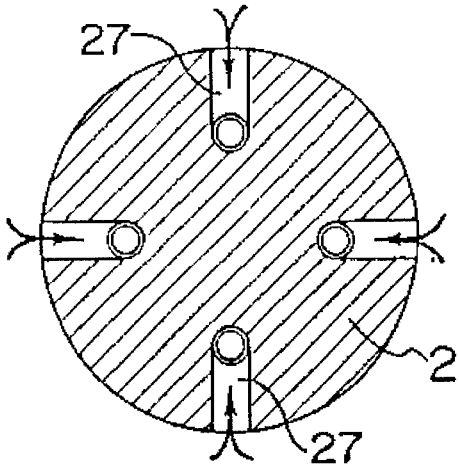
FIG. 7 is a sectional view taken along a line VII—VII in FIG. 6.
Figure 8:
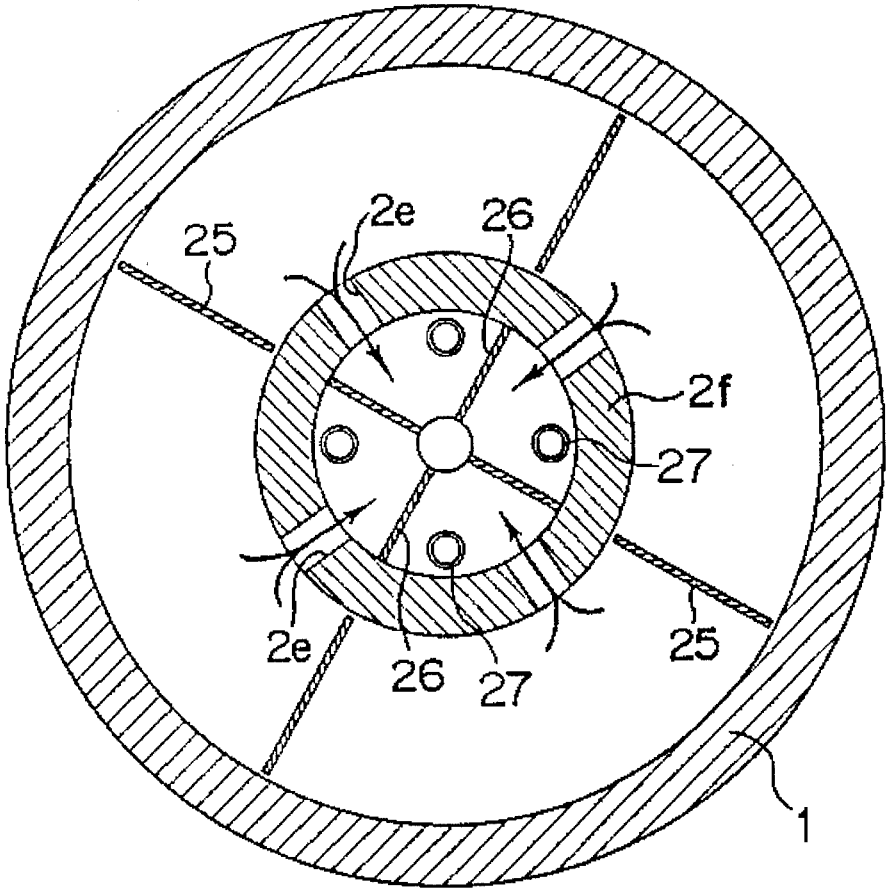
FIG. 8 is a sectional view taken along a line VIII—VIII in FIG. 6.

Referring now to FIG. 6, there is shown a third embodiment of the centrifugal concentrating machine. In a separated liquid portion, an L-shaped bent tube 27 is mounted inside of a partition ring 27*a* on the hub of the screw conveyor 2 to form a radial and horizontal passage as also shown in FIG. 7. In the concentrated liquid discharge portion, deceleration vanes 25 are provided on the dip weir 2A of the screw conveyor 2 similarly to the above mentioned embodiments as shown in FIG. 8. A ring wall 2*f* projecting from the end face for linking with the hollow shaft 21 is formed with radial through-holes 12 and deceleration vanes 26 are disposed within the ring wall 2*f*. The deceleration vanes 26 are secured to the end plate which forms the dip weir 2A.

Figure 9:
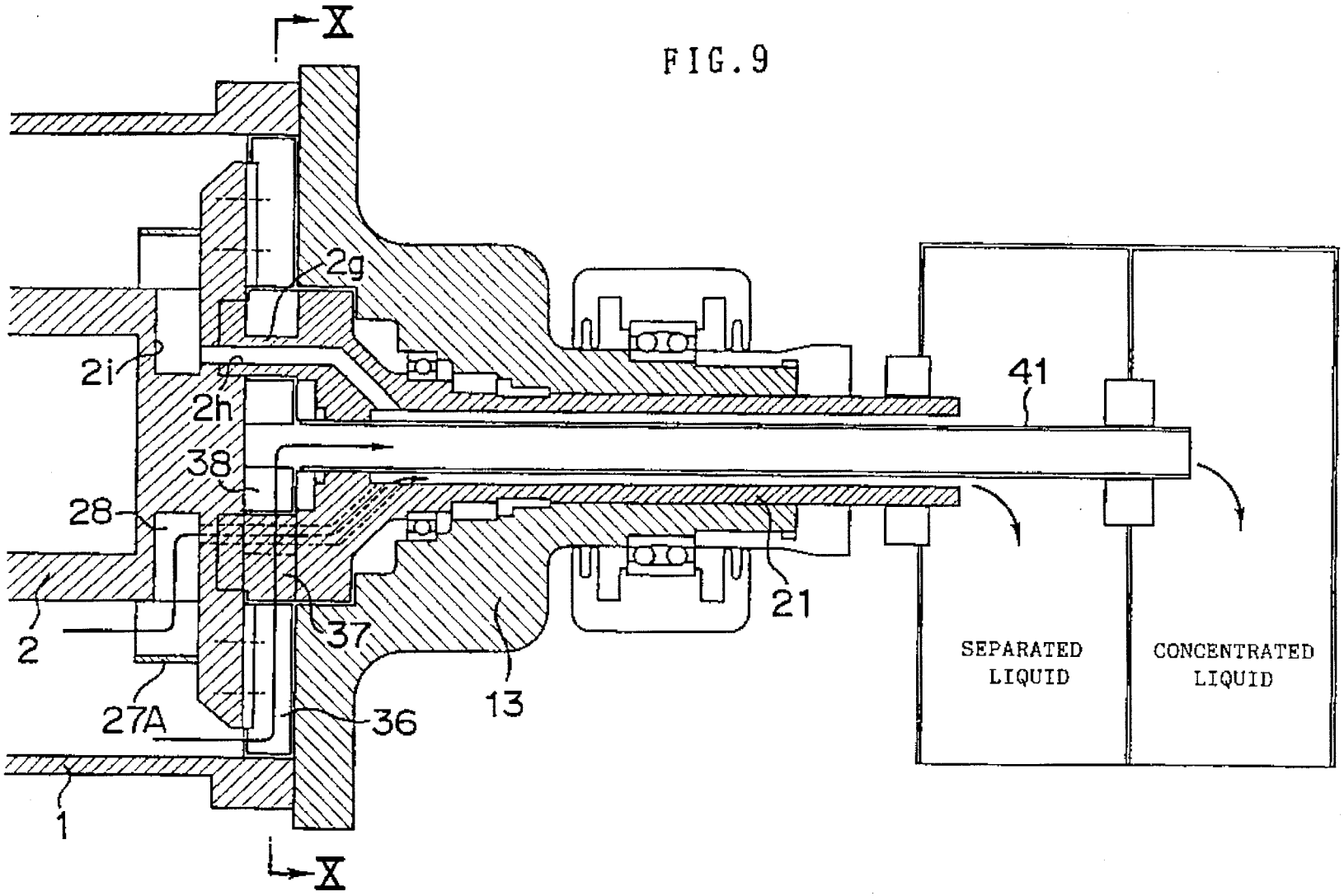
FIG. 9 is a longitudinal sectional view showing a fourth embodiment of a centrifugal concentrating machine of the present invention.

Referring now to FIG. 9, there is shown a fourth embodiment of the centrifugal concentrating machine in which the end portion of the hub of the screw conveyor 2 is linked with the hollow shaft 21 by means of four tubular linking members 2*g*. Each linking member 2*g* is formed therein with a horizontal discharge passage 2*h* for the separated liquid. The hub of the screw conveyor 2 is formed with an open space 2*i* which is communication with the separated liquid discharge passage 2*h*. The open space 2*i* is divided into sectors by deceleration vanes 28.

Figure 10:
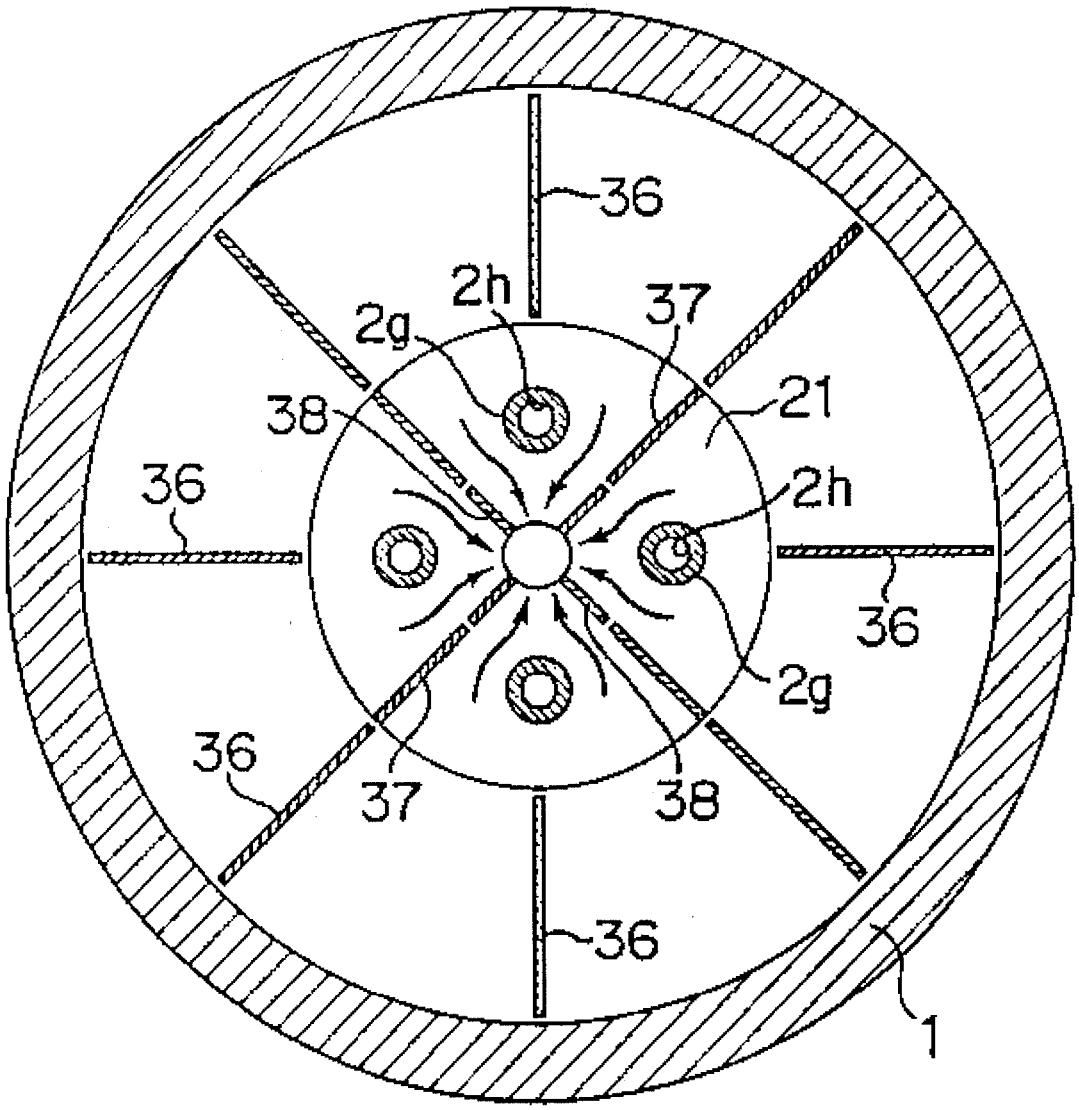
FIG. 10 is a sectional view taken along a line X—X in FIG. 9.

As shown in FIG. 10, the concentrated liquid discharge portion includes first deceleration vanes 38 disposed on such positions that they equally divide the outermost periphery of the screw conveyor end face by 8, second deceleration vanes 37 disposed on such intermediate positions excepting the positions where the linking members 2*g* are disposed that they equally divide intermediate periphery by 8 and third deceleration vanes 38 on innermost positions corresponding to second deceleration vanes 37. In this case, sectors or fan-shaped passages which are substantially continuous from the outermost edge to the axis are formed.

Figure 11:
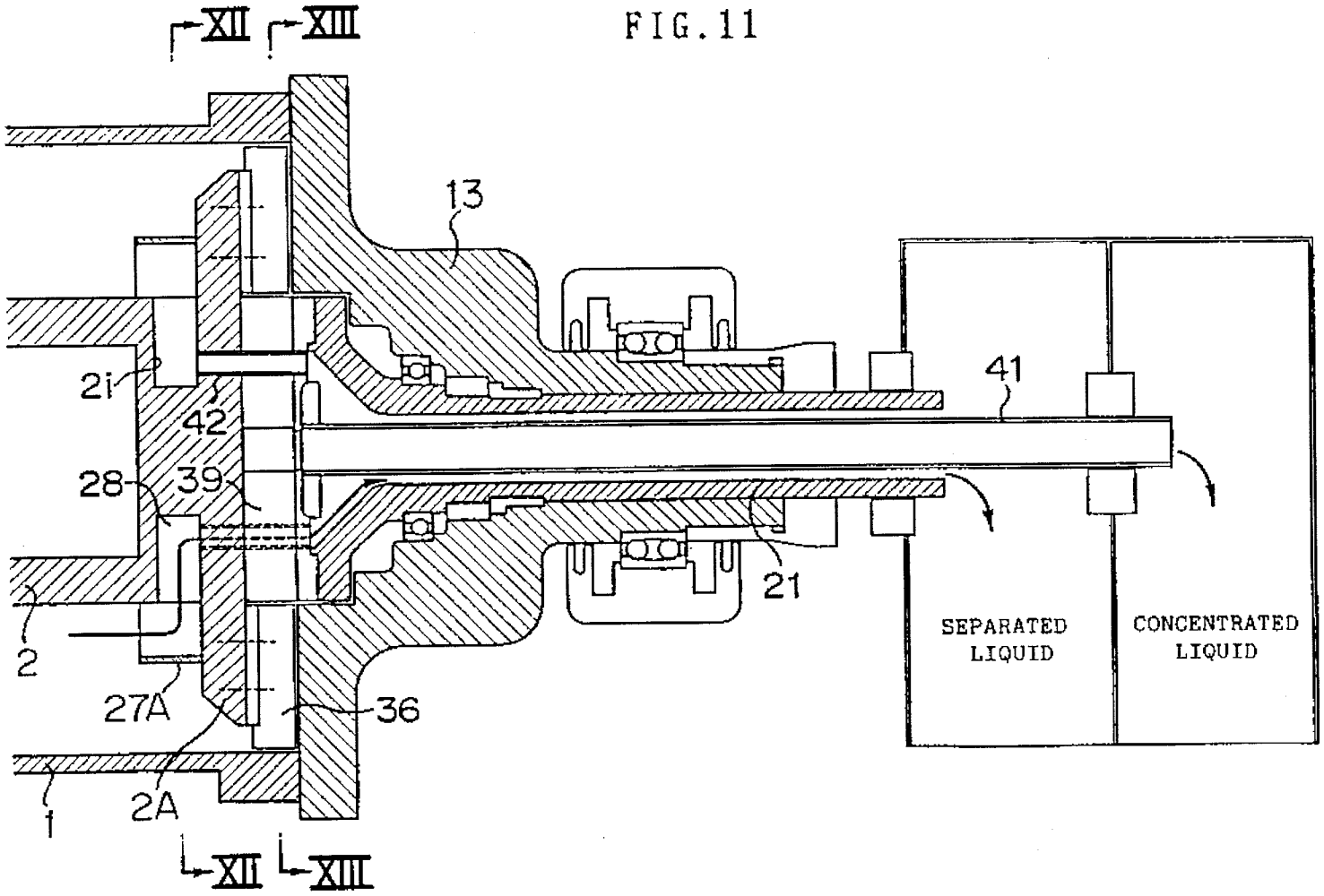
FIG. 11 is a longitudinal sectional view showing a fifth embodiment of a centrifugal concentrating machine of the present invention.
Figure 12:
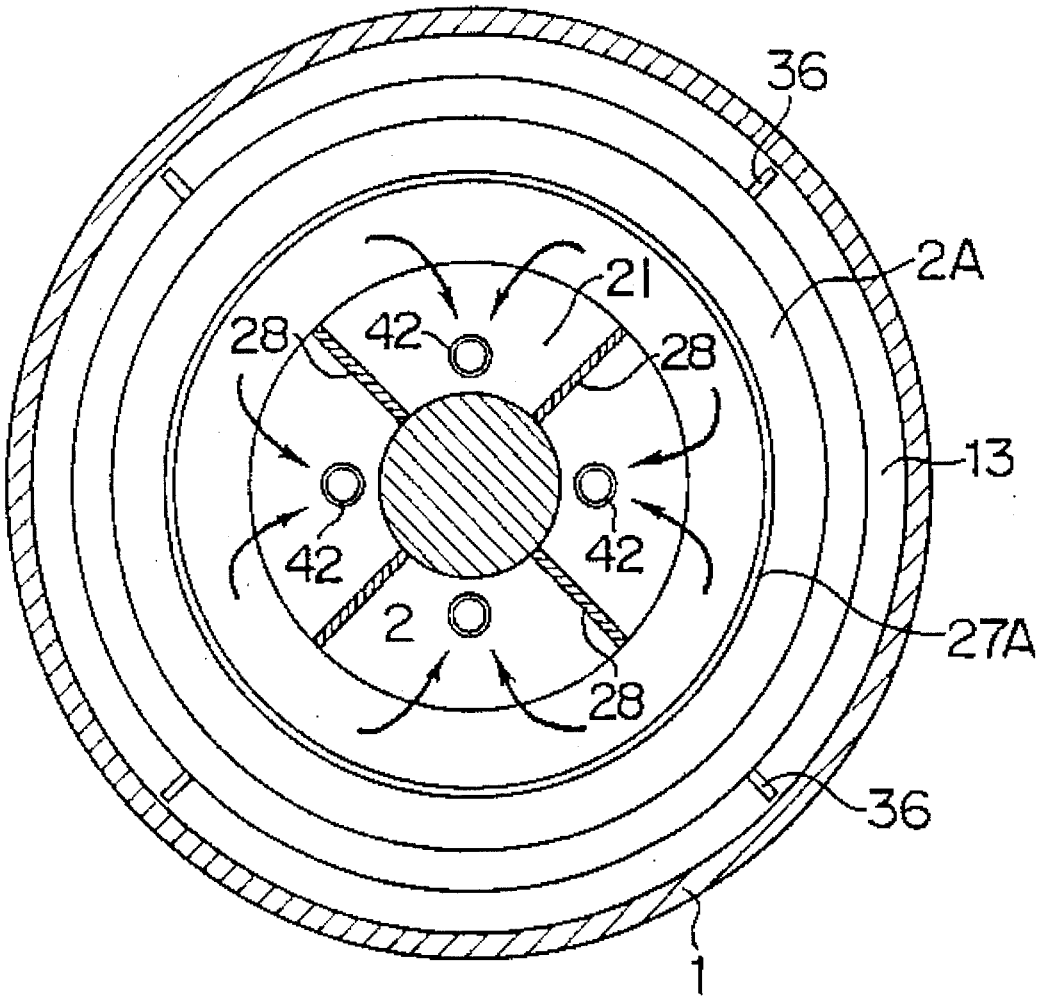
FIG. 12 is a sectional view taken along a line XII—XII in FIG. 11.

Referring now to FIG. 11, there is shown a fifth embodiment of the centrifugal concentrating machine in which deceleration vanes 39 are used as members for linking the screw conveyor 2 with the hollow shaft 21. The separated liquid discharge portion includes an open space 2*i* on the screw hub. The open space 2*i* is divided into sectors by deceleration vanes 28, which are in communication with a separated liquid discharge passage around the outer discharge passage around the outer periphery of the concentrated liquid discharge tube 41 via linking tubes 42.

Figure 13:
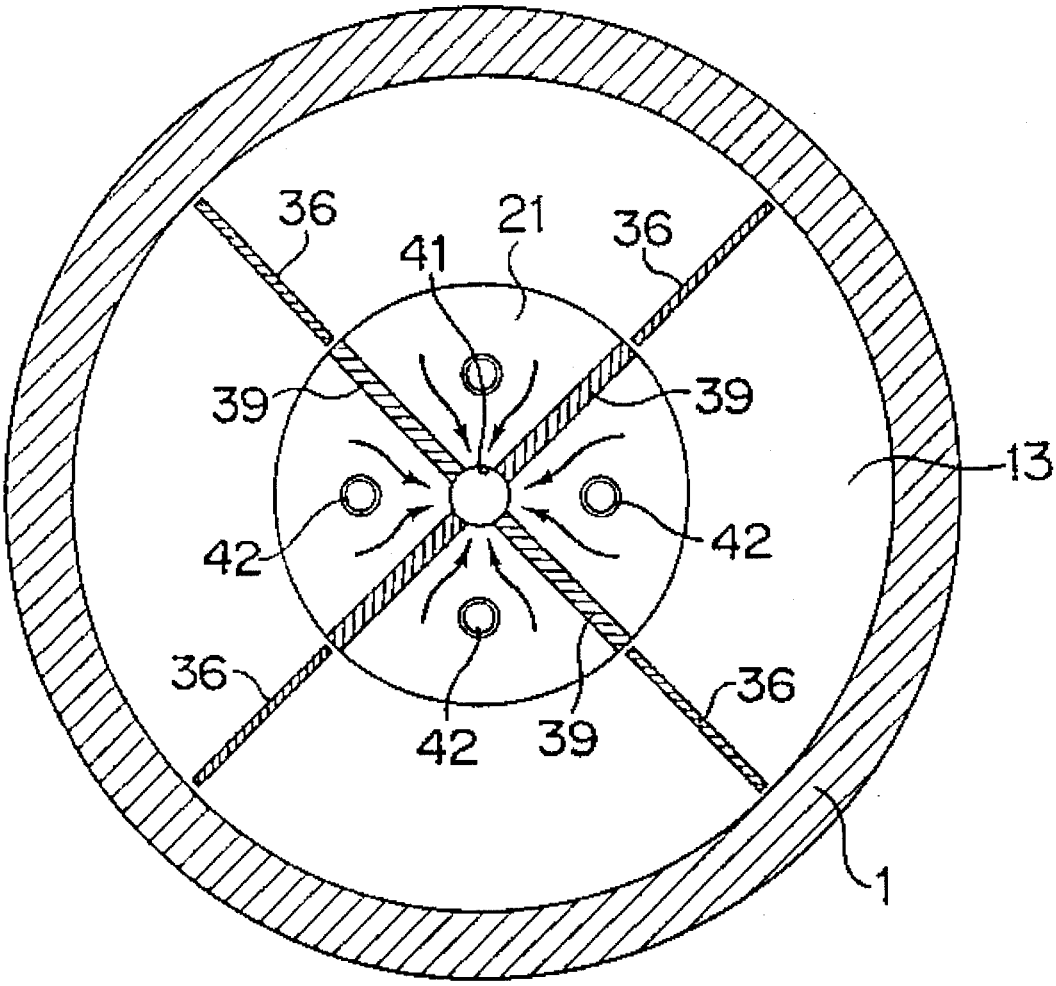
FIG. 13 is a sectional view taken along a line XIII—XIII in FIG. 11.

The concentrated liquid discharge portion is simple in structure since the deceleration vanes 39 also serve as linking members as shown in FIG. 13. Four deceleration vanes 36 disposed on the outer periphery of the end face of the hub of the screw conveyor and four deceleration vanes 39 are disposed along the directions of the first deceleration vanes 36 so that sector or fan-shaped passages which are substantially continuous from the outermost edge to the axis are formed. The deceleration vanes 39 are secured to the screw conveyor 2 and the hollow shaft 21 by, for example, welding and the like.

Although, the deceleration vanes are secured to the screw conveyor 2, for example the dip weir 2A thereof in the above mentioned embodiment, they may be secured to rotary bowl 1, specifically the inner surface of the end wall of the rotary bowl 1.

Figure 14:
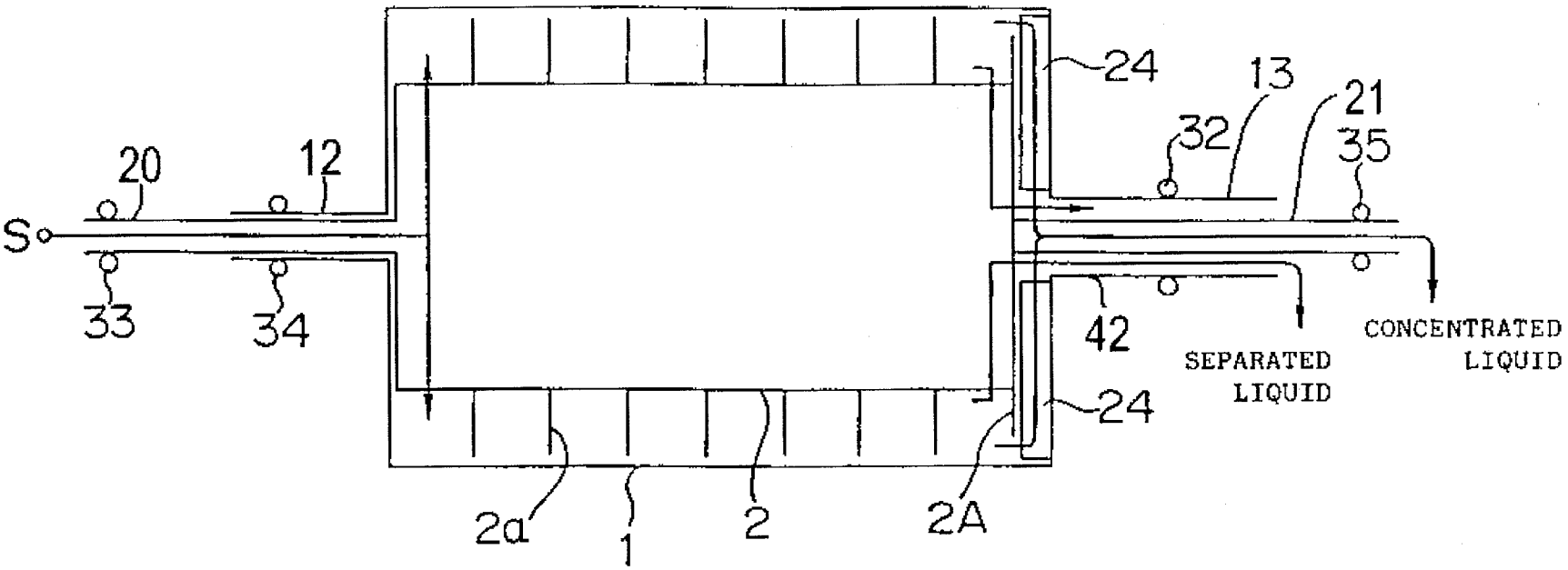
FIG. 14 is a schematic view showing a further modification.

Although the horizontal discharge passage for the concentrated or separated liquid is provided within the hollow shaft of the screw conveyor 2 or within the discharge tube 41 provided in the hollow shaft, in the above mentioned embodiments, the horizontal discharge passage 42 for the separated liquid can be formed in a space between the hollow shaft 13 of the rotary bowl 1 and the hollow shaft 21 of the screw conveyor 2 without providing the discharge tube 41 as schematically shown in FIG. 14. In this case, the concentrated liquid is discharged via the horizontal discharge passage in the hollow shaft 21.

Alternatively, the horizontal discharge passage 42 may be used as the discharge passage for the concentrated liquid and the space in the hollow shaft 21 may be used as the discharge passage for the separated liquid.

Structure for enabling the discharge portion to be in communication with the horizontal passages for the concentrated and separated liquids can be readily presumed from the above mentioned embodiments.

Although not illustrated, a space may be provided between the hollow shaft 12 of the rotary bowl 1 and the hollow shaft 20 of the screw conveyor 2. This space can be used as the horizontal discharge passage for the separated or concentrated liquid.

Figure 15:
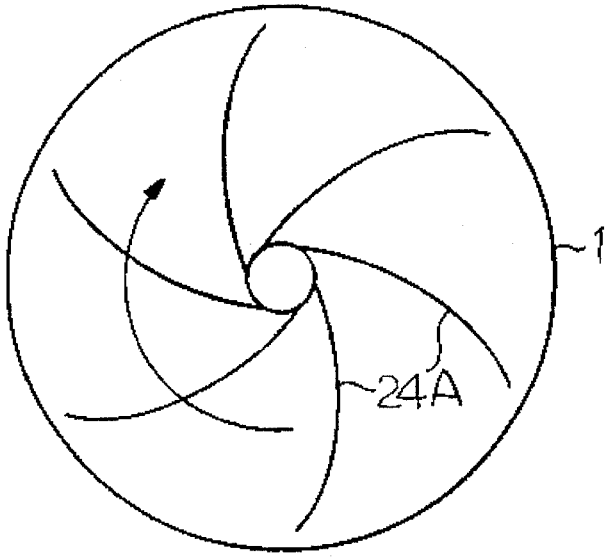
FIG. 15 is a schematic cross sectional view showing a different arrangement of the deceleration vanes.
Figure 16:
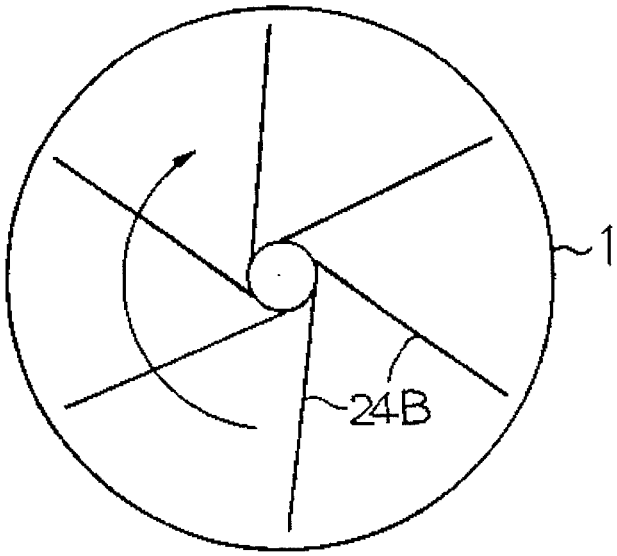
FIG. 16 is a cross sectional view showing another arrangement of the deceleration vanes.

Although the deceleration vanes are disposed in a radial direction from the central axis of the concentrating machine in the above mentioned embdoiments, the deceleration vanes 24A may be arranged so that they are in the form of blades of a spiral pump in section of the concentrating machine as shown in FIG. 15. Alternatively, the deceleration vanes 24B may be arranged so that they are tangential to a virtual circle having a given radius from the central axis as shown in FIG. 16. In these cases, the deceleration vanes 24A or 24B are rotated in a direction represented by an arrow in the drawings. The deceleration efficiency for the liquid to be discharged is higher and the discharge efficiency of the liquid to be discharged is higher in comparison with a case in which the deceleration vanes are arranged in a radial direction from the central axis of the concentrating machine.

Figure 17:
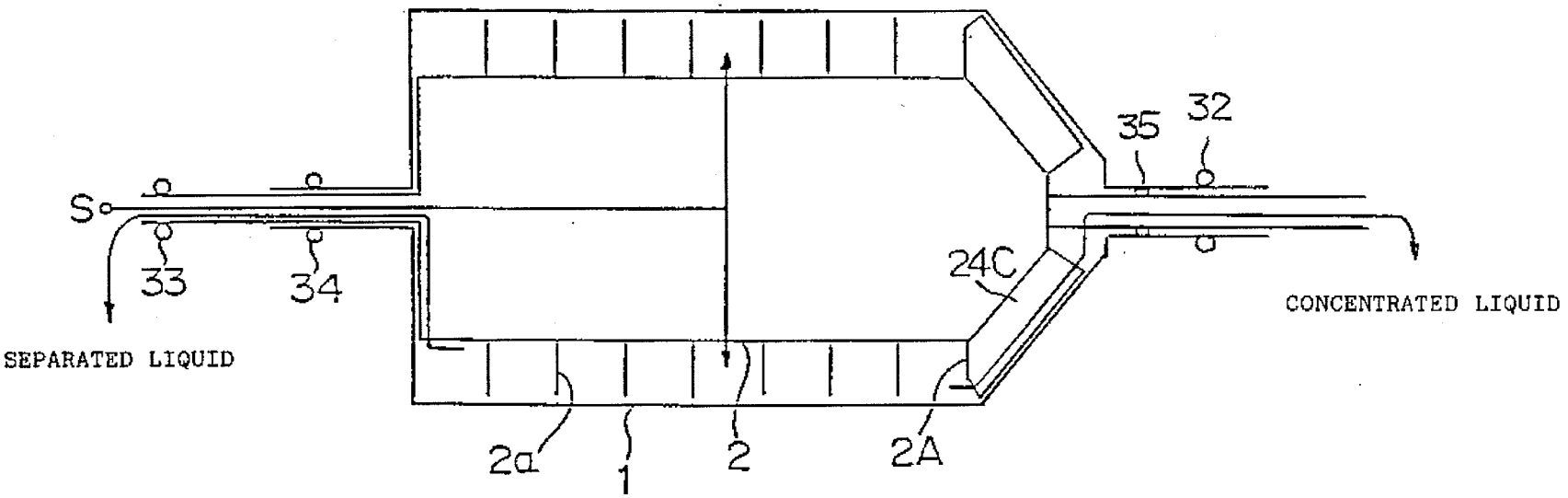
FIG. 17 is a schematic view showing a further embodiment in which the deceleration vanes are inclined.

In accordance with the present invention, the deceleration vanes necessarily need not normally intersect with the central axis in longitudinal section of the concentrating machine. In case where the radial discharge passages are inclinedly formed as shown in FIG. 17, the deceleration vanes 24C may be provided along the inclined radial discharge passages.

The number of the deceleration vanes is preferably not higher than 16, more preferably not higher than 18. More deceleration vanes increases the risk of clogging for, in particular, the concentrated liquid.

In the embodiments excepting the first embodiment, the concentrated and separated liquids are discharged in the same direction. In contrast to this, the concentrated and separated liquids are discharged in right and left directions, respectively in the first embodiment. In the embodiments excepting the first emdodiment, the partition ring 27A is provided for separating the concentrated liquid from the separated liquid.

If many of the fine solids in the concentrated liquid stay near the dip weir portion 2A, the risk that they enter the inside of the partition ring 2A to be mixed with the separated liquid becomes higher. The separation efficiency may not be high. Since the separated and concentrated liquids are discharged in different directions in the first embodiment, it is proved that the separation efficiency is high.

EXAMPLE

Waste activated sludge from sewage having a concentration of 0.8% was supplied to the centrifugal concentrating machine shown in FIG. 1 having a diameter of the rotary bowl of 600 mm and a length of the rotary bowl of 1800 mm at a rate of 20 $m^3$/h and concentration treatment of the sludge was conduced under a centrifugal force of 1200 G. As a result, the consumed power per unit amount of the treated sludge was 0.4 kWH/$m^3$. In contrast to this, a prior art decanter type centrifugal concentrating machine (not axially discharge type) required a consumed power of 0.9 kWH/$m^3$. The consumed power could be reduced to about half. The centrifugal concentrating machine was more simple in structure in comparison with a prior art axial discharge type concentrating machine using a skimmer tube and could be operated in a stable manner without causing wearing and clogging.

As mentioned above in detail, the present invention overcomes the problems such as wearing of the inner walls of the tubes, clogging of the tubes and irregular discharge of liquid which otherwise occur in the prior art using a discharge tube such as skimmer tube. The preset invention provides advantages in that a low rotating driving power is sufficient to drive the machine since the discharged liquid is collected toward the axis of the machine and is then discharged via the supporting shaft portion, in that stable operation is possible and in that adjustment of the balance between the discharge concentrated liquid and the separated water and control of the concentration can be accomplished by changing the number, height and/or width of the deceleration vanes.

What is claimed is:

1. A centrifugal concentrating machine for separating liquid fed to a space between a rotary bowl and a screw conveyor into concentrated liquid and separated liquid by a centrifugal force and for discharging said liquids outside said machine via independent discharge passages, said screw conveyor having an axis and being coaxially disposed within the rotary bowl and further having a pair of supporting shafts, each of said shafts being aligned with said screw conveyor axis, the rotary bowl and the screw conveyor being rotated in the same direction at different high speeds, characterized in that both said supporting shafts of said screw conveyor are hollow, a first discharge passage for the concentrated liquid being formed in the one of the supporting shafts, a second discharge passage for the separated liquid being formed between the other of the supporting shafts and a feed tube coaxially disposed within the other of the supporting shafts, said feed tube being integral with a hub of the screw conveyor and in communication with said space, each of the first and second discharge passages being in communication with said space via first and second radial discharge passages extending radially of said screw conveyor axis, said first and second radial discharge passages formed in said screw conveyor; and wherein each of said first and second radial discharge passages forms an annular space constituting at least an inlet passage through which a respective said liquid flows wherein at least one of said first and second radial discharge passages is divided into sectors by a plurality of deceleration vanes which are arranged in a radial direction with respect to said screw conveyor axis and are secured to one of the screw conveyor and the rotary bowl so that mutual spacings between adjacent sectors becomes wider in an outer radial direction.

2. The centrifugal concentrating machine in claim 1 in which said deceleration vanes are secured to the screw conveyor.

3. The centrifugal concentrating machine as defined in claim 1 in which the deceleration vanes are spiral in shape.

4. A centrifugal concentrating machine for separating liquid fed to a space between a rotary bowl and a screw conveyor into concentrated liquid and separated liquid by a centrifugal force and for discharging said liquids via independent discharge passages, said screw conveyor having an axis and being coaxially disposed within the rotary bowl and further having a pair of supporting shafts, each of said shafts being aligned with said screw conveyor axis, the rotary bowl and the screw conveyor being rotated in the same direction at different high speeds, characterized in that one of the pair of supporting shafts of said screw conveyor is hollow and a discharge tube is disposed coaxially in the one of the supporting shafts, a first discharge passage for the concentrated liquid being formed in one of the inside of said discharge tube and a spacing between the discharge tube and an inside of said hollow supporting shaft, a second discharge passage for the separated liquid being formed in the other of the inside of said discharge tube and a spacing between the discharge tube and an inside of the said hollow supporting shaft, each of said first and second discharge passages being in communication with said space via first and second radial discharges passages extending radially of said screw conveyor axis, said first and second radial discharge passages formed in said screw conveyor to form the discharge passages for the concentrated and separated liquids respectively, and in that an annular space constituting a least an inlet passage through which liquid to be separated flows toward the axis of said screw conveyor in at least one of said first or second radial discharge passages is divided into sectors by a plurality of deceleration vanes which are arranged in a radial direction with respect to said screw conveyor axis and are secured to one of the screw conveyor and the rotary bowl so that mutual spacings between adjacent sectors becomes wider in an outer radial direction, wherein the screw conveyor is formed with a hub on an end thereof near the first discharge passage, the hub formed with a dip weir portion projecting from the outer surface of the hub toward an inner wall of the rotary bowl; said hub further comprising a ring-shaped projection on an end face thereof, said ring-shaped projection including radial through holes as part of said first radial discharge passage, said second radial discharge passage further including L-shaped tubes mounted within said hub and extending within said ring-shaped projection for communication with said second radial discharge passage and extending radially for communication with said space, said deceleration vanes arranged at least within said ring-shaped projection.

5. The centrifugal concentrating machine in claim 4 in which the deceleration vanes are spiral in shape.

6. The centrifugal concentrating machine in claim 4 in which said deceleration vanes are secured to the screw conveyor.

7. A centrifugal concentrating machine for separating liquid fed to a space between a rotary bowl and a screw conveyor into concentrated liquid and separated liquid by a centrifugal force and for discharging said liquids via independent discharge passages, said screw conveyor having an axis and being coaxially disposed within the rotary bowl and further having a pair of supporting shafts, each of said shafts being aligned with said screw conveyor axis, the rotary bowl and the screw conveyor being rotated in the same direction at different high speeds, characterized in that one of the pair of supporting shafts of said screw conveyor is hollow and a discharge tube is disposed coaxially in the one of the supporting shafts, a first discharge passage for the concentrated liquid being formed in one of the inside of said discharge tube and a spacing between the discharge tube and an inside of said hollow supporting shaft, a second discharge passage for the separated liquid being formed in the other of the inside of said discharge tube and a spacing between the discharge tube and an inside of the said hollow supporting shaft, each of said first and second discharge passages being in communication with said space via first and second radial discharge passages extending radially of said screw conveyor axis, said first and second radial discharge passages formed in said screw conveyor to form the discharge passages for the concentrated and separated liquids respectively, and in that an annular space constituting at least an inlet passage through which liquid to be separated flows toward the axis of said screw conveyor in at least one of said first or second radial discharge passages is divided into sectors by a plurality of deceleration vanes which are arranged in a radial direction with respect to said screw conveyor axis and are secured to one of the screw conveyor and the rotary bowl so that mutual spacings between adjacent sectors becomes wider in an outer radial direction, wherein the screw conveyor is formed with a hub on an end thereof near the first discharge passage, the hub formed with a dip weir portion projecting from an outer surface of the hub toward an inner wall of the rotary bowl;

said second radial discharge passage for the separated liquid further comprising a plurality of L-shaped passages in said hub, each L-shaped passage providing communication between said space and said second discharge passage.

8. The centrifugal concentrating machine in claim 7 in which the deceleration vanes are spiral in shape.

9. The centrifugal concentrating machine in claim 7 in which said deceleration vanes are secured to the screw conveyor.

10. A centrifugal concentrating machine for separating liquid fed to a space between a rotary bowl and a screw conveyor into concentrated liquid and separated liquid by a centrifugal force and for discharging said liquids via independent discharge passages, said screw conveyor having an axis and being coaxially disposed within the rotary bowl and further having a pair of supporting shafts each of said shafts being aligned with said screw conveyor axis, the rotary bowl and the screw conveyor being rotated in the same direction at different high speeds, characterized in that one of the pair of supporting shafts of said screw conveyor is hollow and a discharge tube is disposed coaxially in the one of the supporting shafts, a first discharge passage for the concentrated liquid being formed in one of the inside of said discharge tube and a spacing between the discharge tube and an inside of said hollow supporting shaft, a second discharge passage for the separated liquid being formed in the other of the inside of said discharge tube and a spacing between the discharge tube and an inside of the said hollow supporting shaft, each of said first and second discharge passages being in communication with said space via first and second radial discharge passages extending radially of said screw conveyor axis, said first and second radial discharge passages formed in said screw conveyor to form the discharge passages for the concentrated and separated liquids respectively, and in that an annular space constituting at least an inlet passage through which liquid to be separated flows toward the axis of said screw conveyor in at least one of said first or second radial discharge passages is divided into sectors by a plurality of deceleration vanes which are arranged in a radial direction with respect to said screw conveyor axis and are secured to one of the screw conveyor and the rotary bowl so that mutual spacings between adjacent sectors becomes wider in an outer radial direction, wherein the screw conveyor is formed with a hub on an end thereof near the first discharge passage, the hub formed with a dip weir portion projecting from an outer surface of the hub toward an inner wall of the rotary bowl;

said second radial discharge passage further comprising a plurality of tubular linking members extending from an end face of said hub to said second discharge passage, each said tubular linking member connecting said second discharge passage with said space.

11. The centrifugal concentrating machine in claim 10, wherein said deceleration vanes are within said first radial discharge passage, said vanes further comprising one set of vanes mounted to an outer periphery of said end face of said hub and a second set of said vanes mounted to an end of said first discharge passage.

12. The centrifugal concentrating machine in claim 10 in which the deceleration vanes are spiral in shape.

13. The centrifugal concentrating machine in claim 10 in which said deceleration vanes are secured to the screw conveyor.

* * * * *